US010989377B2

(12) United States Patent
Van Bommel et al.

(10) Patent No.: US 10,989,377 B2
(45) Date of Patent: Apr. 27, 2021

(54) LIGHTING DEVICE AND A METHOD OF MANUFACTURING A LIGHTING DEVICE

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/646,519

(22) PCT Filed: Sep. 7, 2018

(86) PCT No.: PCT/EP2018/074122

§ 371 (c)(1),
(2) Date: Mar. 11, 2020

(87) PCT Pub. No.: WO2019/052912

PCT Pub. Date: Mar. 21, 2019

(65) Prior Publication Data

US 2020/0271288 A1 Aug. 27, 2020

(30) Foreign Application Priority Data

Sep. 14, 2017 (EP) ..... 17191001

(51) Int. Cl.
*F21S 4/24* (2016.01)
*F21Y 103/10* (2016.01)
(Continued)

(52) U.S. Cl.
CPC ..... *F21S 4/24* (2016.01); *F21Y 2103/10* (2016.08); *F21Y 2107/50* (2016.08); *F21Y 2115/10* (2016.08)

(58) Field of Classification Search
CPC ..... F21S 4/24; F21Y 2103/10; F21Y 2115/10; F21Y 2107/50; F21Y 2107/70; F21Y 2107/90
See application file for complete search history.

(56) References Cited

U.S. PATENT DOCUMENTS 5,709,461 A 1/1998 Michl et al.
2002/0177092 A1 11/2002 Latzel
(Continued)

FOREIGN PATENT DOCUMENTS

CN 202501406 U 10/2012
CN 204943084 U 1/2016
(Continued)

*Primary Examiner* — Donald L Raleigh
(74) *Attorney, Agent, or Firm* — Daniel J. Piotrowski

(57) ABSTRACT

A lighting device (1) is disclosed, comprising at least a first elongated carrier (2) and a second elongated carrier (3), each of the first elongated carrier (2) and the second elongated carrier being foldable (3). At least the first elongated carrier (2) and the second elongated carrier (3) have been folded over each other such that a plurality of sections (16) of the first elongated carrier (2) are interleaved with respect to a plurality of sections (17) of the second elongated carrier (3) so as to form an interleaved structure (10). The interleaved structure (1) may have been arranged such that a plurality of cavities (9) in the interleaved structure (10) are formed, each cavity (9) at least being constituted by a surface (12) of one of the sections (16) of the first elongated carrier (2) and a surface (13) of one of the sections (17) of the second elongated carrier (3), wherein the surfaces (12, 13) of the sections (16, 17) of the first elongated carrier (2) and the second elongated carrier (3), respectively, at least in part face each other.

15 Claims, 7 Drawing Sheets

(51) Int. Cl.
*F21Y 115/10* (2016.01)
*F21Y 107/50* (2016.01)

(56) References Cited

U.S. PATENT DOCUMENTS

| | | | | |
|---|---|---|---|---|
| 2008/0244944 | A1* | 10/2008 | Nall | F21S 2/005 40/544 |
| 2011/0109235 | A1 | 5/2011 | Link | |
| 2014/0313721 | A1 | 10/2014 | Morgan | |
| 2015/0117005 | A1 | 4/2015 | Zanotto et al. | |
| 2017/0082251 | A1 | 3/2017 | Tannahill et al. | |
| 2017/0265307 | A1* | 9/2017 | Makkonen | H05B 45/20 |

FOREIGN PATENT DOCUMENTS

| | | | | |
|---|---|---|---|---|
| CN | 205690136 | U * | 11/2016 | F21S 4/22 |
| CN | 205690136 | U | 11/2016 | |
| CN | 107110468 | A | 8/2017 | |
| WO | 2009072422 | A1 | 6/2009 | |
| WO | 2017093063 | A1 | 12/2015 | |

* cited by examiner

LIGHTING DEVICE AND A METHOD OF MANUFACTURING A LIGHTING DEVICE

CROSS-REFERENCE TO PRIOR APPLICATIONS

This application is the U.S. National Phase application under 35 U.S.C. § 371 of International Application No. PCT/EP2018/074122, filed on Sep. 7, 2018, which claims the benefit of European Patent Application No. 17191001.1, filed on Sep. 14, 2017. These applications are hereby incorporated by reference herein.

TECHNICAL FIELD

The present invention relates to a lighting device and a method of manufacturing a lighting device, which lighting device comprises at least a first elongated carrier and a second elongated carrier, which for example may comprise or be constituted by light strips, such as, for example, light-emitting diode (LED) light strips.

BACKGROUND

Light strips—for example comprising flexible printed circuit boards (PCBs) configured to support one or more light sources—may facilitate installation of several light sources to achieve a desirable light effect. Light-emitting diode (LED) light strips (or LED strip) are widely available and used for various applications, including outdoor lighting (e.g., architectural lighting) and indoor lighting, and are used in both consumer and professional applications. Advantages with LED strips include miniaturization and a flexibility with regard to form factor. Some LED strips may be relatively easily customized, e.g., they may be cut to a desired length. LED strips may for example have a length from one to several meters, such as up to five meters or even more. LED strips may be integrated with other electronics and may exhibit functionality such as connectivity to other electrical devices, e.g., to other LED strips, LED drivers, etc. LED strips may include several LEDs which for example may be arranged as one or more LED strings. For example, a LED strip may comprise a flexible PCB which is configured to support one or more LEDs or LED strings, and which may be covered with a transparent material or a diffusor. For outdoor applications, LED strips may be covered by a conformal coating made or encapsulated by a sleeve for example made of Silicone or Polyurethane or a similar material.

On a LED strip with a flexible PCB, the flexible PCB is usually flat, and LEDs are usually arranged on one of the sides of the flat, flexible PCB. Therefore, light emission from such a LED strip may be directed from the LED strip only in one general direction. However, it would be desirable to have a LED strip which allows for a greater flexibility in directionality of the light emission from the LED strip.

CN 202501406 discloses a light bar group that is equipped with at least one light emitting assembly and comprises two light bar units. Each light bar unit includes a wire layer provided with a plurality of wires exposing on the upper surface of the wire layer, upper and lower insulating layers coating the wire layer, and a conductive connecting part arranged on at least one end of the light bar unit. The upper insulating layer is provided with at least one opening part, the conductive connecting part includes a base part and a bending part bending from the base part, and a clamping space is formed between the bending part and the base part. The bending part of one light bar unit is inserted in the clamping space of the other light bar unit so that the two light bar units are connected with each other

SUMMARY

For example, it would be desirable to have a LED strip which allows or facilitates for an adjustability or configurability of the direction of light emission therefrom, and which possibly may further allow or facilitate for providing light mixing and/or light collimation functionality with respect to the light emitted by the LED strip.

In view of the above, a concern of the present invention is to provide a lighting device comprising elongated carriers for supporting light-emitting element(s) thereon, such as, for example, a LED strip or another type of light strip, which allows or facilitates for an adjustability or configurability of the direction of light emission therefrom, and which possibly may further allow or facilitate for providing light mixing and/or light collimation functionality with respect to the emitted light.

To address at least one of this concern and other concerns, a lighting device and a method of manufacturing a lighting device as defined by the independent claims are provided. Preferred embodiments are defined by the dependent claims.

According to a first aspect of the present invention there is provided a lighting device. The lighting device comprises at least a first elongated carrier and a second elongated carrier. At least one of the first elongated carrier and the second elongated carrier is configured to support at least one light-emitting element. Each of the first elongated carrier and the second elongated carrier is foldable. At least the first elongated carrier and the second elongated carrier have been (possibly repeatedly) folded over each other, thereby forming a plurality of folds in each of the first elongated carrier and the second elongated carrier, such that a plurality of sections (or portions) of the first elongated carrier are interleaved with respect to a plurality of sections (or portions) of the second elongated carrier so as to form an interleaved structure.

The interleaved structure may hence comprise at least the first elongated carrier and the second elongated carrier. By at least the first elongated carrier and the second elongated carrier having been folded over each other such that a plurality of sections of the first elongated carrier are interleaved with respect to a plurality of sections of the second elongated carrier, to form an interleaved structure, the plurality of sections of the first elongated carrier are arranged alternatively and regularly between the plurality of sections of the second elongated carrier, or vice versa.

Each or any one of the first elongated carrier and the second elongated carrier may be flexible. The first elongated carrier and/or the second elongated carrier may for example comprise one or more flexible printed circuit boards (PCBs) and/or one or more flexible foils ('flexfoils') which may be configured to support at least one light-emitting element, and which may be configured to provide power to the at least one light-emitting element (e.g., by way of the first elongated carrier and/or the second elongated carrier including one or more electrically conductive tracks or traces, as known in the art). The first elongated carrier and/or the second elongated carrier may for example comprise a strip (e.g., a light strip), such as, for example, a LED strip. Each or any one of the first elongated carrier and the second elongated carrier may for example be shaped so as to be rectangular, or substantially rectangular, as seen from one side thereof.

By way of the folding of at least the first elongated carrier and the second elongated carrier over each other such that a plurality of sections of the first elongated carrier are interleaved with respect to a plurality of sections of the second elongated carrier so as to form an interleaved structure, it may be facilitated or allowed for adjustability or configurability of the direction of light emission therefrom in the lighting device according to the first aspect. Furthermore, a lighting device according to the first aspect may further facilitate or allow for providing a good light mixing and/or light collimation functionality with respect to the emitted light. Furthermore, a lighting device according to the first aspect may further facilitate thermal management in the lighting device (e.g., by facilitating dissipation of heat generated from operation of any light-emitting element that may be comprised in the lighting device). Such adjustability or configurability, functionality and/or facilitation of thermal management may for example be achieved by selective positioning of light-emitting element(s) on one or more of the sections of the first elongated carrier and/or on one or more of the sections of the second elongated carrier in the interleaved structure (e.g., by positioning of light-emitting element(s) in the interleaved structure in different ways), and/or by selective arrangement of the interleaved structure. For example, the interleaved structure may be or have been arranged (e.g., stretched out) such that a plurality of cavities in the interleaved structure are formed. Each cavity may at least be constituted by a surface of one of the sections (or portions) of the first elongated carrier and a surface of one of the sections (or portions) of the second elongated carrier, wherein the surfaces of the sections of the first elongated carrier and the second elongated carrier, respectively, at least in part face each other. The surface of the section of the first elongated carrier may be arranged at a selected angle with respect to the surface of the section of the second elongated carrier. For example, the first elongated carrier and the second elongated carrier may from a folded state (e.g., a state in which the plurality of sections of the first elongated carrier and the plurality of sections of the second elongated carrier are overlying each other in a stacked arrangement) may be arranged (e.g., stretched out) such that a plurality of cavities in the interleaved structure are formed. The size and/or shape of the cavities may for example depend on the extent to which the first elongated carrier and the second elongated carrier are stretched out. Light-emitting element(s) may be arranged so as to be inside one or more of any such cavities. By arranging light-emitting element(s) so as to be inside one or more of any such cavities, a good light mixing functionality with respect to the light emitted from the lighting device may be achieved. Also, by selective positioning of light-emitting element(s) on one or more of the sections of the first elongated carrier and/or on one or more of the sections of the second elongated carrier in one or more cavities of the interleaved structure (examples will be described in the following), adjustability or configurability of the direction of light emission from the lighting device may be achieved, and possibly also a good light mixing and/or light collimation functionality with respect to the light emitted from the lighting device and/or a facilitation of thermal management in the lighting device. By positioning of light-emitting element(s) on one or more of the sections of the first elongated carrier and/or on one or more of the sections of the second elongated carrier in one or more cavities of the interleaved structure, the direction of light emission from respective light-emitting elements that are arranged along a length of the lighting device may be different for different light-emitting elements. For example, different light-emitting elements that are arranged along a length of the lighting device may be tilted in different angles with respect to a longitudinal axis of the lighting device.

In the context of the present application, by a cavity in the interleaved structure it is meant an empty space between at least two surfaces of the interleaved structure. The cavity is arranged so as permit light emitted by any light-emitting element(s) inside the cavity to exit the cavity and be emitted from the lighting device.

The forming of the plurality of cavities in the interleaved structure may be carried out such that consecutive light-emitting elements arranged along a length of the lighting device and being supported by the first elongated carrier and/or the second elongated carrier—possibly at one side thereof—may be tilted in increasing (or decreasing) angles with respect to a longitudinal axis of the lighting device, for example, in steps of 10 degrees (or about 10 degrees), between consecutive light-emitting elements. The side of the first and/or second elongated carrier may extend along the length of the first elongated and the second elongated carrier, respectively. According to an example, a first light-emitting element is not—or only very little—tilted with respect to the longitudinal axis of the lighting device, a second light-emitting element is tilted with respect to the longitudinal axis of the lighting device at an angle of 10 degrees (or about 10 degrees), a third light-emitting element is tilted with respect to the longitudinal axis of the lighting device at an angle of 20 degrees (or about 20 degrees), and so on. The tilting angle steps must not necessarily be 10 degrees, and may for example be in a range of 1 to 65 degrees, or 3 to 55 degrees, or 5 to 50 degrees.

Another way to describe the (possibly repeated) folding of at least the first elongated carrier and the second elongated carrier such that a plurality of sections of the first elongated carrier are interleaved with respect to a plurality of sections of the second elongated carrier so as to form an interleaved structure, is that each of at least the first elongated carrier and the second elongated carrier may comprise so called 'valley' fold(s) and 'mountain' fold(s) (or folding lines) in an alternating manner. For example, the first elongated carrier may comprise consecutively arranged sections A, B, A, B, . . . , with alternatingly 'mountain' folds M and 'valley' folds V between the sections A, B, A, B, . . . , e.g., on a first side of the first elongated carrier. Similarly, the second elongated carrier may comprise consecutively arranged sections C, D, C, D, . . . , with alternatingly 'mountain' folds M and 'valley' folds V between the sections C, D, C, D, . . . , e.g., on a first side of the second elongated carrier. Thereby, there may be 'valley' and 'mountain' folds (or folding lines) in an alternating manner V, M, V, M, . . . between the consecutively arranged sections A, B, A, B, . . . and C, D, C, D, . . . of the first elongated carrier and the second elongated carrier, respectively. In this regard, the terms 'valley' folds and 'mountain' folds may allude to the relative positions of the respective folds in the interleaved structure, for example when it has been stretched out such as described in the foregoing. The first side of the first and/or second elongated carrier may extend along the length of the first elongated and the second elongated carrier, respectively.

The first elongated carrier and/or the second elongated carrier may be arranged such that the surface(s) of the sections of the first elongated carrier and/or the second elongated carrier constituting an above-mentioned cavity is/are specularly or diffusively reflective, which may facilitate providing or improving light collimation functionality with respect to the light emitted by the lighting device. The reflectivity of the surface(s) of the sections of the first elongated carrier and/or the second elongated carrier may for example be 80% or more, or 85% or more, or 87% or more.

Each of the plurality of portions or sections of the first elongated carrier may be adjoining (i.e., be next to and joined with) at least one other portion or section of the plurality of portions or sections of the first elongated carrier. Each of the plurality of portions or sections of the second elongated carrier may be adjoining at least one other portion or section of the plurality of portions or sections of the second elongated carrier.

According to one or more embodiments of the present invention, the lighting device may comprise more than two elongated carriers, each of which may be foldable. Three or more, e.g., four, of the elongated carriers may be (possibly repeatedly) folded over each other such that a plurality of sections or portions of the respective elongated carriers are or become interleaved to form the interleaved structure.

As mentioned in the foregoing, each or any one of the first elongated carrier and the second elongated carrier may be flexible. Thereby, the interleaved structure may be flexible, and may be arranged in different forms or shapes. For example, the interleaved structure might be shaped such that the interleaved sections of the first elongated carrier and the second elongated carrier, respectively, are arranged along a (substantially) straight line, or such that the interleaved sections of the first elongated carrier and the second elongated carrier, respectively, are arranged so that they form a circular, or oval shape. Different parts or portions of the interleaved structure may be arranged in different forms or shapes.

The lighting device may comprise several interleaved structures, which may be interconnected. Each interleaved structure may extend along a longitudinal axis thereof or along a longitudinal axis of the lighting device. One interleaved structure may be connected at an end thereof to another interleaved structure, at an end thereof. The interleaved structures may be interconnected for example using any connecting means or technique as known in the art, such as, for example, gluing.

Any light-emitting element supported by the first elongated carrier or the second elongated carrier may be arranged on one of the sections of the first elongated carrier or the second elongated carrier, respectively, which sections are interleaved with the sections of the second elongated carrier and the first elongated carrier, respectively.

For example, at least the first elongated carrier may comprise a plurality of light-emitting elements supported by the first elongated carrier, as indicated in the foregoing. At least one of the light-emitting elements may be arranged on each of at least some of the sections or portions of the first elongated carrier. The wording 'each of at least some' is to be understood that 'some' sections or portions of the elongated carrier may be selected, and that at least one of the light-emitting elements of the plurality of light emitting elements is arranged in 'each' of the selected sections or portions. Alternatively, 'each of at least some' may be written as 'each of the selected'.

In addition, or in alternative, the second elongated carrier may comprise a plurality of light-emitting elements supported by the second elongated carrier. At least one of the light-emitting elements may be arranged on each of at least some of the sections or portions of the second elongated carrier.

Each of at least some of the cavities may have at least one light-emitting element arranged on the section or portion of the first elongated carrier of the cavity. Each of at least some of the cavities may have at least one light-emitting element arranged on the section or portion of the second elongated carrier of the cavity.

The first elongated carrier may comprise at least a first side and a second side. Each of the first side and the second side may extend along the length of the first elongated carrier. The first side and the second side may be opposite sides of the first elongated carrier. The plurality of light-emitting elements may be arranged on the first side of the first elongated carrier, but not on the second side of the first elongated carrier.

Each of the plurality of sections of the first elongated carrier may be adjoining at least one other section of the plurality of sections of the first elongated carrier so as to form a succession of contiguous sections.

According to one or more embodiments of the present invention, alternatingly at least one section in the succession of contiguous sections may have at least on light-emitting element arranged thereon, and at least one section in the succession of contiguous sections may have no light-emitting element arranged thereon.

In addition, or in alternative, and according to one or more other embodiments of the present invention, each section in the succession of contiguous sections may have at least on light-emitting element arranged thereon. Alternatingly at least one section in the succession of contiguous sections may have at least one light-emitting element arranged thereon on the first side and at least one section in the succession of contiguous sections may have at least one light-emitting element arranged thereon on the second side.

In the context of the present application, by a succession of contiguous sections (of an elongated carrier) it is meant that the sections are connected or joined throughout in an unbroken succession.

As indicated in the foregoing, the second elongated carrier may comprise a plurality of light-emitting elements supported by the second elongated carrier. At least one of the light-emitting elements may be arranged on each of at least some of the sections or portions of the second elongated carrier.

The second elongated carrier may comprise at least a first side and a second side. Each of the first side and the second side may extend along the length of the second elongated carrier. The first side and the second side may be opposite sides of the second elongated carrier. The plurality of light-emitting elements may be arranged on the first side of the second elongated carrier, but not on the second side of the second elongated carrier.

According to an example, six or more light-emitting elements may be arranged on each or any side of the first elongated carrier and/or the second elongated carrier. According to an examples, twelve, eighteen, twenty, fifty or hundred or more light-emitting elements may be arranged on each or any side of the first elongated carrier and/or the second elongated carrier.

Each of the plurality of sections of the second elongated carrier may be adjoining at least one other section of the plurality of sections of the second elongated carrier so as to form a succession of contiguous sections. Alternatingly at least one section in the succession of contiguous sections may have at least on light-emitting element arranged thereon and at least one section in the succession of contiguous sections may have no light-emitting element arranged thereon.

The first elongated carrier may have a width W1 different from a width of the second elongated carrier W2. A ratio between a width (W1) of the first elongated carrier and a width of the second elongated carrier (W2) may be in a range between 0.2 and 5. For example, a ratio between W1 and W2 may be in a range between 0.2 and 5, or between 0.9 and 1.1. According to an example, a ratio between W1 and W2 may be 1. Thus, W1 and W2 may be the same (or substantially the same).

The width of the first elongated carrier and/or the width of the second elongated carrier may for example be in a range between 0.1 cm and 10 cm, such as between 0.1 cm and 2 cm, or between 0.4 cm and 1 cm.

The plurality of sections of the first elongated carrier may have a length L1 along a longitudinal axis thereof. The plurality of sections of the second elongated carrier may have a length L2 along a longitudinal axis thereof. L1 and L2 may be different for different ones of the sections of the first elongated carrier and the second elongated carrier, respectively, or L1 and L2 may be the same for different ones (or all) of the sections of the first elongated carrier and the second elongated carrier, respectively. A ratio between L1 and L2 may for example be in a range between 0.8 and 1.2, for example 1, or about 1. L1 and/or L2 may for example be in a range between 0.2 cm and 5 cm, for example in a range between 0.5 cm and 3 cm, or in a range between 0.7 cm and 2 cm, such as, for example 1 cm, or about 1 cm. L1 may be equal to, or about equal to, W1. L2 may be equal to, or about equal to, W2. According to one example, L1, L2, W1 and W2 are all the same (i.e., L1=L2=W1=W2), or about the same.

The lighting device may be arranged such that at least the first elongated carrier and the second elongated carrier in the interleaved structure are fixedly arranged with respect to each other. To that end, the lighting device may for example be arranged such that the interleaved structure is partially or completely encased or encapsulated in a polymer such as, for example, silicone rubber, or in another appropriate material. In addition, or in alternative, according to another example, at least one of the at least the first elongated carrier and the second elongated carrier may comprise or be constituted by a semi-rigid, foldable, carrier, such as, for example, a metal strip.

Each or any one of the light-emitting element(s) comprised in the lighting device may for example include or be constituted by a solid state light emitter. Examples of solid state light emitters include light-emitting diodes (LEDs), laser diodes and organic LEDs (OLEDs). Solid state light emitters are relatively cost efficient light sources since they in general are relatively inexpensive and have a relatively high optical efficiency and a relatively long lifetime. However, in the context of the present application, the term "light-emitting element" should be understood to mean substantially any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore, a light-emitting element can have monochromatic, quasi-monochromatic, polychromatic or broadband spectral emission characteristics. Examples of light-emitting elements include semiconductor, organic, or polymer/polymeric LEDs, violet LEDs, blue LEDs, optically pumped phosphor coated LEDs, optically pumped nano-crystal LEDs or any other similar devices as would be readily understood by a person skilled in the art. Furthermore, the term light-emitting element can, according to one or more embodiments of the present invention, mean a combination of the specific light-emitting element(s) which emit the radiation in combination with a housing or package within which the specific light-emitting element(s) is positioned or arranged. For example, the term light-emitting element or light-emitting module can encompass a bare LED die arranged in a housing, which may be referred to as a LED package. According to another example, the light-emitting element may comprise a Chip Scale Package (CSP) LED, which may comprise a LED die directly attached to a substrate such as a PCB, and not via a sub-mount.

Each or any one of the light-emitting element(s) supported by the first and/or second elongated carrier may for example be capable of emitting white light, and may for example comprise one or more LEDs capable of emitting white light, or several LEDs including at least one blue, red and green LED, respectively (e.g., an RGB LED). In alternative, or in addition, each or any one of the light-emitting element(s) supported by the first and/or second elongated carrier may for example be capable of emitting red, green, or blue light, and may for example comprise one or more LEDs capable of emitting red, green, or blue light. In alternative, or in addition, each or any one of the light-emitting element(s) supported by the first and/or second elongated carrier may for example comprise several LEDs, with at least one of the LEDs capable of emitting white light and with at least one other LED capable of emitting light of another color, e.g., blue, red or green, and with LEDs capable of emitting white light and LED capable of emitting light of another color possibly being alternatingly arranged.

Each or any one of the light-emitting element(s) supported by the first and/or second elongated carrier may be capable of emitting light having a particular color temperature. Possibly, all of the light-emitting element(s) supported by the first and/or second elongated carrier could be capable of emitting light having the same color temperature, for example white light having a color temperature of 3500 K, or about 3500 K. At least some of the light-emitting element(s) supported by the first and/or second elongated carrier could be capable of emitting light having different color temperature, for example white light having a color temperature between 3000 K and 4000 K.

According to one or more embodiments of the present invention, each or any one of the light-emitting element(s) supported by the first elongated carrier may be capable of emitting light having a first color temperature, and each or any one of the light-emitting element(s) supported by the second elongated carrier may be capable of emitting light having a second color temperature, with the first color temperature and the second color temperature being different.

According to one or more embodiments of the present invention, each or any one of the light-emitting element(s) supported by the first elongated carrier on the first side thereof may be capable of emitting light having a first color temperature, and each or any one of the light-emitting element(s) supported by the first elongated carrier on the second side thereof may be capable of emitting light having a second color temperature, with the first color temperature and the second color temperature being different. Similarly, each or any one of the light-emitting element(s) supported by the second elongated carrier on the first side thereof may be capable of emitting light having a third color temperature, and each or any one of the light-emitting element(s) supported by the second elongated carrier on the second side thereof may be capable of emitting light having a fourth color temperature, with the third color temperature and the fourth color temperature being different.

According to one or more embodiments of the present invention, the lighting device may comprise attachment means for removably or detachably attaching the lighting device to another object. The attachment means could for example comprise a clip or clamp.

According to a second aspect of the present invention there is provided a lamp, a light engine or a luminaire comprising a lighting device according to the first aspect of the present invention. A lighting device according to the first aspect of the present invention may for example be used in a LED lamp, such as, for example, a tubular LED lamp, a so called LED bulb, or as a replacement for a coil in a LED retrofit lamp having an appearance similar to a 'traditional' incandescent light bulb. A lighting device according to the first aspect of the present invention may be used as a filament for a LED lamp for mimicking an incandescent lamp. A lighting device according to the first aspect of the present invention may be arranged in a tube, which tube may be employed for implementing an arc of an arc lamp, such as a LED-based arc lamp.

According to a third aspect of the present invention there is provided a method of manufacturing a lighting device comprising at least a first elongated carrier and a second elongated carrier. At least one of the first elongated carrier and the second elongated carrier is configured to support at least one light-emitting element. Each of the first elongated carrier and the second elongated carrier is foldable. The method comprises folding at least the first elongated carrier and the second elongated carrier (possibly repeatedly) over each other such that a plurality of sections (or portions) of the first elongated carrier are interleaved with respect to a plurality of sections (or portions) of the second elongated carrier so as to form an interleaved structure. The method may comprise providing the at least a first elongated carrier and the second elongated carrier.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the invention will be described below with reference to the accompanying drawings.

Figure 1:
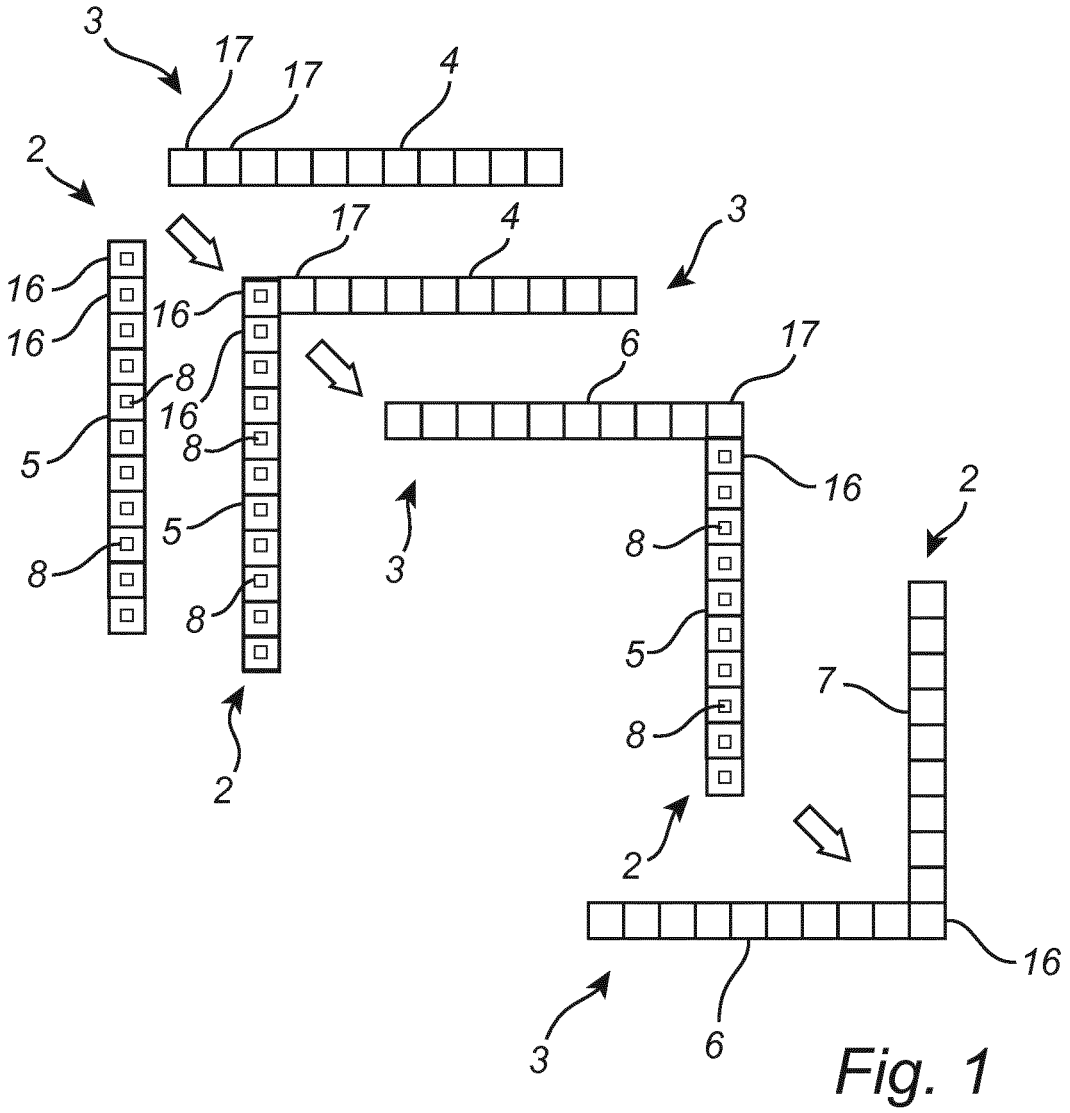
FIG. 1 is a schematic view of a first elongated carrier and a second elongated carrier in accordance with an embodiment of the present invention.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments of the present invention are provided by way of example so that this disclosure will convey the scope of the invention to those skilled in the art. In the drawings, identical reference numerals denote the same or similar components having a same or similar function, unless specifically stated otherwise.

FIG. 1 is a schematic view of a first elongated carrier 2 and a second elongated carrier 3 in accordance with an embodiment of the present invention, which first and second elongated carriers 2, 3 are arranged so as to form an interleaved structure. In FIG. 1, the first and second elongated carriers 2, 3 are seen from one side thereof. According to the embodiment of the present invention illustrated in FIG. 1, each of the first and second elongated carriers 2, 3 is foldable, and the first elongated carrier 2 and the second elongated carrier 3 are folded over each other such that sections 16 of the first elongated carrier 2 become interleaved with respect to sections 17 of the second elongated carrier 3 so as to form an interleaved structure, as described further in the following. Only some of the sections 16 and 17 of the first and second elongated carriers 2 and 3, respectively, are indicated by reference numerals in FIG. 1.

In accordance with the embodiment of the present invention illustrated in FIG. 1, each of the sections 16 of the first elongated carrier 2 is adjoining at least one other section 16 of the sections 16 of the first elongated carrier 2 so as to form a succession of contiguous sections 16. Similarly, each of the sections 17 of the second elongated carrier 3 is adjoining at least one other section 17 of the sections 17 of the second elongated carrier 3 so as to form a succession of contiguous sections 17. However, it is to be understood that this is not required, and that all of the sections 16 of the first elongated carrier 2 may not form a succession of contiguous sections, and that all of the sections 17 of the second elongated carrier 3 may not form a succession of contiguous sections.

In accordance with the embodiment of the present invention illustrated in FIG. 1, the first and second elongated carriers 2, 3 may foldable at least at the lines illustrated in FIG. 1 separating adjacent ones of the sections 16 and 17, respectively, which lines may be referred to as folding lines. It is however to be understood that the configuration of the folding lines as illustrated in FIG. 1 is according to an example, and that other configurations are possible. For example, the folding lines must not necessarily be straight, and the folding lines must not necessarily be arranged perpendicularly to a length axis of the first and second elongated carriers 2 and 3, respectively.

Each or any one of the first and second elongated carriers 2, 3 may be configured to support a plurality of light-emitting elements. In accordance with the embodiment of the present invention illustrated in FIG. 1, the first elongated carrier 2 is configured to support a plurality of light-emitting elements 8. The second elongated carrier 3 may or may not be configured to support light-emitting element(s). Each or any one of the light-emitting elements 8 may for example comprise one or more LEDs, but is not limited thereto. For example, each or any one of the light-emitting elements 8 could, in alternative, or in addition, comprise one or more other types of solid state light emitters.

In accordance with the embodiment of the present invention illustrated in FIG. 1, the first elongated carrier 2 comprises a first side 5 and a second side 7, with each of the first side 5 and the second side 7 extending along the length of the first elongated carrier 2. The first side 5 and the second side 7 are opposite sides of the first elongated carrier 2. Also, as illustrated in FIG. 1, the light-emitting elements 8 supported by the first elongated carrier 2 are arranged on the first side 5 of the first elongated carrier 2, while there are no light-emitting elements arranged on the second side 7 of the first elongated carrier 2. However, in accordance with one or more other embodiments of the present invention, there could instead be light-emitting element(s) arranged on only the second side 7 of the first elongated carrier 2, or there could be light-emitting element(s) arranged on both the first side 5 and the second side 7 of the first elongated carrier 2.

Further in accordance with the embodiment of the present invention illustrated in FIG. 1, the second elongated carrier 3 comprises a first side 4 and a second side 6, with each of the first side 4 and the second side 6 extending along the length of the second elongated carrier 2. The first side 4 and the second side 6 are opposite sides of the second elongated carrier 3. As illustrated in FIG. 1, there are no light-emitting elements arranged on any of the first side 4 and the second side 6 of the second elongated carrier 3. However, in accordance with one or more other embodiments of the present invention, there could be light-emitting element(s) arranged on one or on both of the first side 4 and the second side 6 of the second elongated carrier 3.

Each or any one of the first and second elongated carriers 2, 3 may be flexible, and may for example comprise a flexible PCB and/or a flexfoil, which may be configured to provide power to any light-emitting element arranged thereon. Each or any one of the first and second elongated carriers 2, 3 may for example comprise a light strip, such as, for example, a LED strip.

A method of folding the first elongated carrier 2 and the second elongated carrier 3 over each other such that sections 16 of the first elongated carrier 2 become interleaved with respect to sections 17 of the second elongated carrier 3 is illustrated in FIG. 1 in four steps from the top left in FIG. 1 to the bottom right in FIG. 1, with the transitions between the four steps indicated by the arrows in FIG. 1. As illustrated in FIG. 1, between the second and third steps, and also between the third and fourth steps, the first elongated carrier 2 and the second elongated carrier 3 are folded over each other such that sections 16 of the first elongated carrier 2 become interleaved with respect to sections 17 of the second elongated carrier 3. The method may continue in the same way as illustrated in FIG. 1 with folding additional sections of the first elongated carrier 2 and the second elongated carrier 2, respectively, over each other, in order to form an interleaved structure.

By means of the method indicated in FIG. 1, the first elongated carrier 2 and the second elongated carrier 3 in the interleaved structure may be brought into a folded state (or semi-folded), e.g., a state in which sections 16 of the first elongated carrier 2 and sections 17 of the second elongated carrier 3 are overlying each other in a stacked arrangement. As mentioned in the foregoing, each or any one of the first and second elongated carriers 2, 3 may be flexible. By stretching out the first elongated carrier 2 and the second elongated carrier 3 in the interleaved structure when the first elongated carrier 2 and the second elongated carrier 3 are in such a stacked arrangement, one or more cavities in the interleaved structure may be formed, which cavities may be in the form of empty space(s) between at least two surfaces of the interleaved structure.

Figure 2:
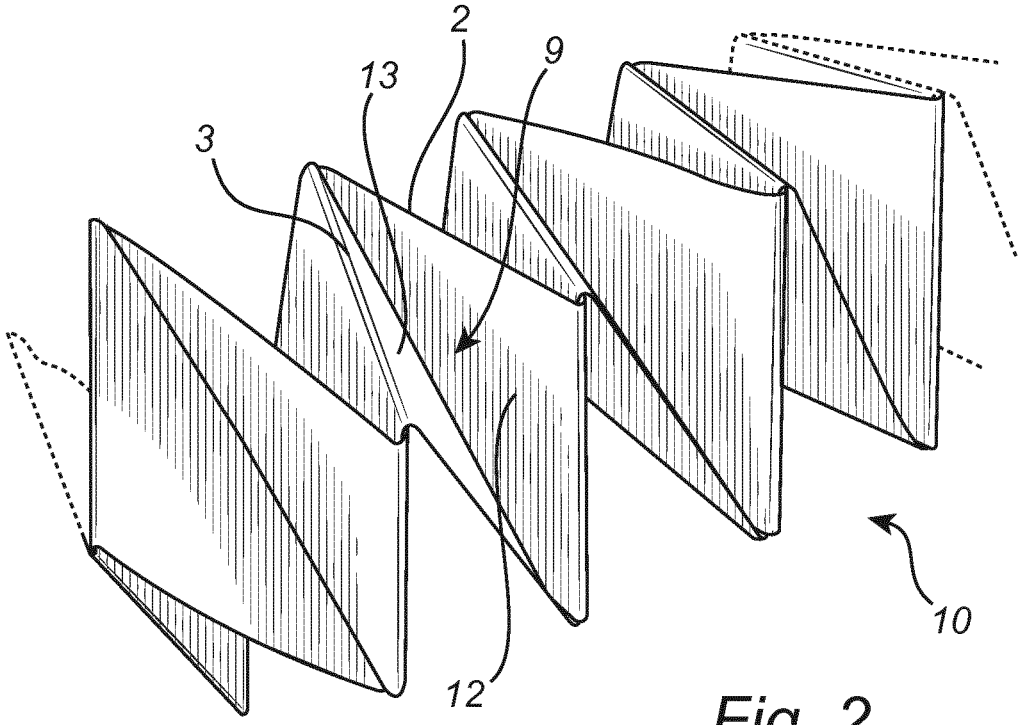
FIG. 2 is a schematic perspective view of an interleaved structure in accordance with an embodiment of the present invention.

FIG. 2 is a schematic perspective view of an interleaved structure 10 in accordance with an embodiment of the present invention, with the interleaved structure 10 having been formed from a first elongated carrier 2 and a second elongated carrier 3 in accordance with a method indicated in FIG. 1. In accordance with the embodiment of the present invention illustrated in FIG. 2, the interleaved structure 10 has been arranged, by stretching out the first elongated carrier 2 and the second elongated carrier 3 after having been folded over each other such as indicated in FIG. 1, such that a plurality of cavities 9 in the interleaved structure 10 are formed. Only one of the cavities is indicated by reference numeral in FIG. 2. Each cavity 9 is at least constituted by a surface 12 of one of the sections 16 of the first elongated carrier 2 and a surface 13 of one of the sections 17 of the second elongated carrier 3, wherein the surfaces 12 and 13 of the sections 16 and 17 of the first elongated carrier 2 and the second elongated carrier 3, respectively, at least in part face each other, as illustrated in FIG. 2. The number of cavities in the interleaved structure 10 shown in FIG. 2 is according to an example, and it is to be understood that the interleaved structure 10 may in principle comprise any number of cavities, possibly even a single cavity, for example.

As illustrated in FIG. 1, the first elongated carrier 2 may comprise a plurality of light-emitting elements 8 supported by the first elongated carrier 2, wherein, on the first side 5 of the first elongated carrier 2, one light-emitting element 8 (or several light-emitting elements) is arranged on each of the sections 16 of the first elongated carrier 2. Thereby, although not shown in FIG. 2, at least some, or even all, of the cavities 9 in the interleaved structure 10 may have at least one light-emitting element 8 arranged on the section 16 of the first elongated carrier 2 of the cavity 9. In alternative, or in addition, there may be one or more light-emitting elements arranged on each of the sections 16 of the first elongated carrier 2 on the second side 7 of the first elongated carrier 2.

As mentioned in the foregoing, the second elongated carrier 3 may comprise a plurality of light-emitting elements supported by the second elongated carrier 3 (not shown in FIG. 1 or 2). In alternative, or in addition, at least one of the light-emitting elements supported by the second elongated carrier 3 may be arranged on each of at least some of the sections 17 of the second elongated carrier 3, and each of at least some of the cavities may have at least one light-emitting element arranged on the section 17 of the second elongated carrier 3 of the cavity.

FIGS. 3-10 are schematic views of a first elongated carrier 2 and a second elongated carrier 3. Each of FIGS. 3-10 depicts, from left to right, a first side 5 of the first elongated carrier 2, a second side 7 of the first elongated carrier 2, a first side 4 of the second elongated carrier 3, and a second side 6 of the second elongated carrier 3. FIGS. 3-10 illustrate different configurations of light-emitting elements 8 in the lighting device in accordance with embodiments of the present invention. Only some of the light-emitting elements 8 are indicated by reference numerals in FIGS. 3-10.

In accordance with each of the embodiments of the present invention illustrated in FIGS. 3-10, each of the first and second elongated carriers 2, 3 is foldable, and the first elongated carrier 2 and the second elongated carrier 3 may be folded over each other (not illustrated or indicated in FIGS. 3-10) such that sections 16 of the first elongated carrier 2 become interleaved with respect to sections 17 of the second elongated carrier 3 so as to form an interleaved structure (not shown in FIGS. 3-10). Only some of the sections 16 and 17 of the first and second elongated carriers 2 and 3, respectively, are indicated by reference numerals in FIGS. 3-10.

With respect to each of the embodiments of the present invention illustrated in FIGS. 3-10, an interleaved structure may be formed from the first elongated carrier 2 and the second elongated carrier 3 for example in accordance with a method illustrated in FIG. 1. The first elongated carrier 2 and the second elongated carrier 3, having been folded over each other such as indicated in FIG. 1, may be stretched out such that a plurality of cavities 9 (cf. FIG. 2) in the interleaved structure are formed, wherein the light-emitting elements 8 may be positioned in the cavities 9 in configurations corresponding to the respective ones of the embodiments of the present invention illustrated in FIGS. 3-10.

In accordance with the embodiments of the present invention illustrated in FIGS. 3-10, each of the sections 16 of the first elongated carrier 2 is adjoining at least one other section 16 of the first elongated carrier 2 so as to form a succession of contiguous sections 16. Similarly, each of the sections 17 of the second elongated carrier 3 is adjoining at least one other section 17 of the second elongated carrier 3 so as to form a succession of contiguous sections 17. However, it is to be understood that this is not required, and that all of the sections 16 of the first elongated carrier 2 may not form a succession of contiguous sections, and that all of the sections 17 of the second elongated carrier 3 may not form a succession of contiguous sections.

Figure 3:
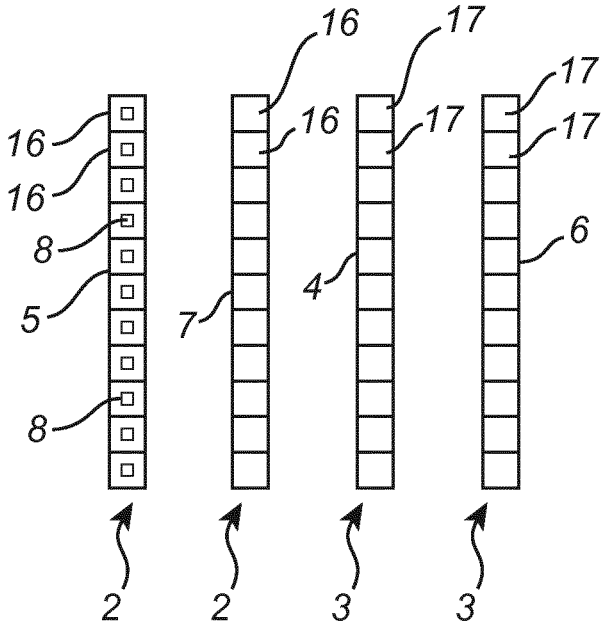
FIGS. 3-10 are schematic views of a first elongated carrier and a second elongated carrier in accordance with different embodiments of the present invention.

According to the embodiment of the present invention illustrated in FIG. 3, on the first side 5 of the first elongated carrier 2, a light-emitting element 8 is arranged on each of the sections 16 of the first elongated carrier 2 No light-emitting element is arranged on the second side of the first elongated carrier 2 or on the second elongated carrier 3. There could possibly be more than one light-emitting element 8 arranged on each of the sections 16 of the first elongated carrier 2. A configuration of light-emitting elements 8 in the lighting device such as illustrated in FIG. 3 may be relatively easy to produce—and hence be relatively inexpensive—and may facilitate thermal management in the lighting device.

Figure 4:
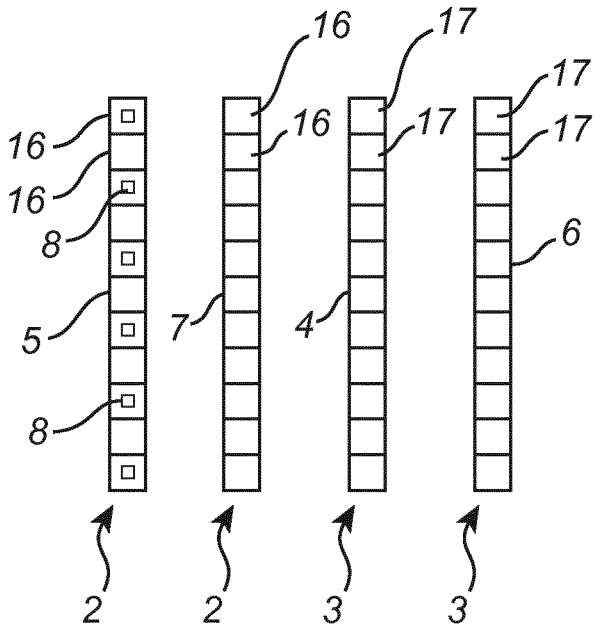

According to the embodiment of the present invention illustrated in FIG. 4, on the first side 5 of the first elongated carrier 2, alternatingly one section in the succession of contiguous sections 16 of the first elongated carrier 2 has a light-emitting element 8 arranged thereon (or possibly several light-emitting elements 8 arranged thereon) and one section in the succession of contiguous sections 16 of the first elongated carrier 2 has no light-emitting element arranged thereon. No light-emitting element is arranged on the second side 7 of the first elongated carrier 2 or on the second elongated carrier 3. By stretching out the first elongated carrier 2 and the second elongated carrier 3, having been folded over each other such as illustrated in FIG. 1, such that a plurality of cavities 9 (cf. FIG. 2) in the interleaved structure are formed, the light-emitting elements 8 may be directed in different directions from the lighting device with respect to each other.

Figure 5:
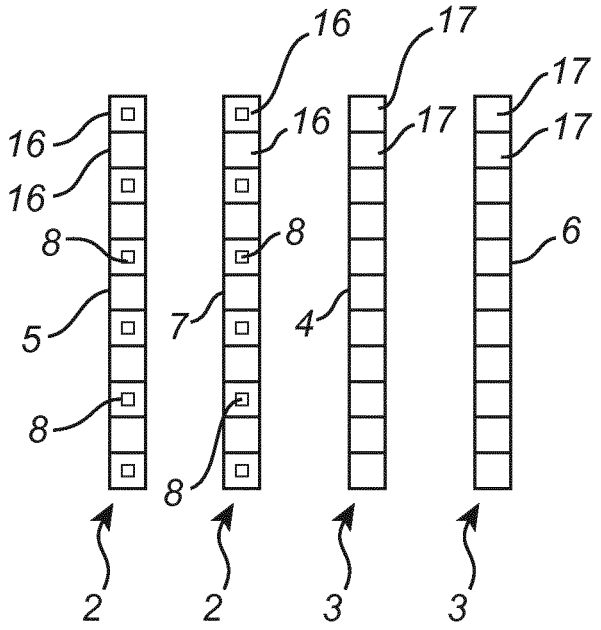

As indicated in the foregoing, there may be more than one light-emitting element 8 arranged on one or more of the sections 16 of the first elongated carrier 2 (and/or possibly more than one light-emitting element 8 arranged on one or more of the sections 17 of the second elongated carrier 3). The embodiment of the present invention illustrated in FIG. 5 is similar to the embodiment of the present invention illustrated in FIG. 4. According to the embodiment of the present invention illustrated in FIG. 5, in addition, on the second side 7 of the first elongated carrier 2, alternatingly one section in the succession of contiguous sections 16 of the first elongated carrier 2 has a light-emitting element 8 arranged thereon (or possibly several light-emitting elements 8 arranged thereon) and one section in the succession of contiguous sections 16 of the first elongated carrier 2 has no light-emitting element arranged thereon. Each of the contiguous sections 16 of the first elongated carrier 2 having light-emitting elements arranged thereon has light-emitting element(s) arranged on both the first side 5 of the first elongated carrier 2 and on the second side 7 of the first elongated carrier 2. No light-emitting element is arranged on the second elongated carrier 3. By stretching out the first elongated carrier 2 and the second elongated carrier 3, having been folded over each other such as illustrated in FIG. 1, such that a plurality of cavities 9 (cf. FIG. 2) in the interleaved structure are formed, the light-emitting elements 8 may be directed in different directions from the lighting device with respect to each other, and in even more directions as compared to, for example, the embodiment of the present invention illustrated in FIG. 4.

Figure 6:
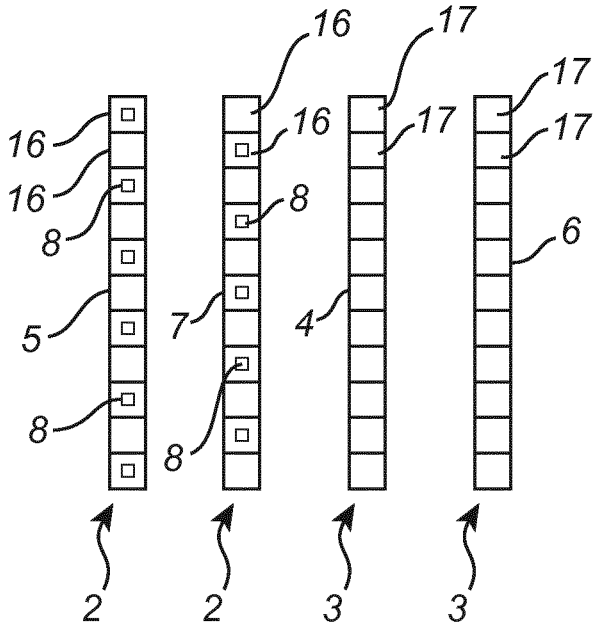

The embodiment of the present invention illustrated in FIG. 6 is similar to the embodiment of the present invention illustrated in FIG. 5. According to the embodiment of the present invention illustrated in FIG. 6, each section in the succession of contiguous sections 16 of the first elongated carrier 2 has one light-emitting element 8 arranged thereon (or possibly several light-emitting elements 8 arranged thereon), wherein alternatingly one section 16 in the succession of contiguous sections 16 has a light-emitting element 8 arranged thereon on the first side 5 of the first elongated carrier 2, and one section 16 in the succession of contiguous sections 16 has a light-emitting element 8 arranged thereon on the second side 7 of the first elongated carrier 2. No light-emitting element is arranged on the second elongated carrier 3. By the first elongated carrier 2 not comprising sections 16 with light-emitting elements 8 arranged on both the first side 5 and the second side 7 of the first elongated carrier 2, light may be emitted in relatively many directions from the lighting device while thermal management in the lighting device may be facilitated.

Figure 7:
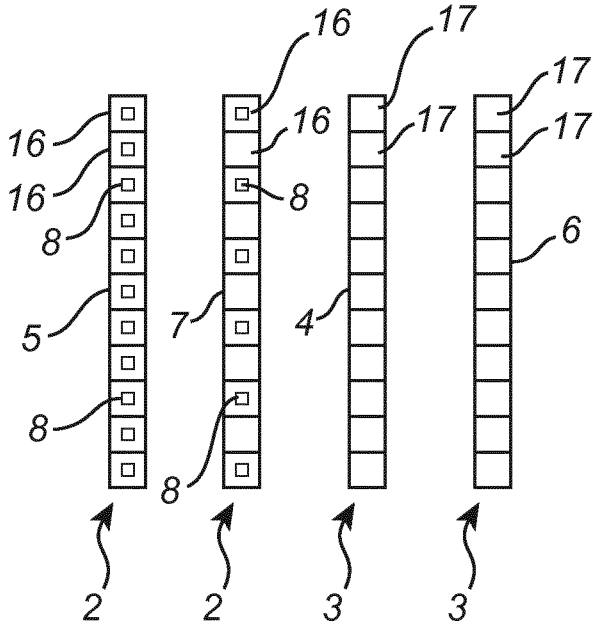

According to the embodiment of the present invention illustrated in FIG. 7, there is more than one light-emitting element 8 arranged on some of the sections 16 of the first elongated carrier 2 (and/or possibly more than one light-emitting element 8 arranged on some of the sections 17 of the second elongated carrier 3). On the first side 5 of the first elongated carrier 2, a light-emitting element 8 (or possibly several light-emitting elements 8) is arranged on each of the sections 16 of the first elongated carrier 2. Furthermore, on the second side 7 of the first elongated carrier 2, alternatingly one section 16 in the succession of contiguous sections 16 of the first elongated carrier 2 has a light-emitting element 8 arranged thereon (or possibly several light-emitting elements 8 arranged thereon) and one section 16 in the succession of contiguous sections 16 of the first elongated carrier 2 has no light-emitting element arranged thereon. Also, no light-emitting element is arranged on the second elongated carrier 3. By stretching out the first elongated carrier 2 and the second elongated carrier 3, having been folded over each other such as illustrated in FIG. 1, such that a plurality of cavities 9 (cf. FIG. 2) in the interleaved structure are formed, the light-emitting elements 8 may be directed in different directions from the lighting device with respect to each other, and in even more directions as compared to, for example, the embodiments of the present invention illustrated in FIGS. 4 and 6.

Figure 8:
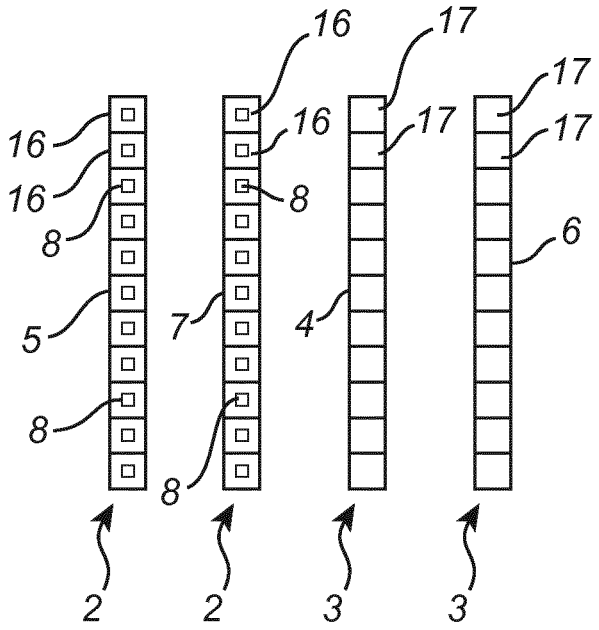

According to the embodiment of the present invention illustrated in FIG. 8, on the first side 5 of the first elongated carrier 2, a light-emitting element 8 (or possibly several light-emitting elements 8) is arranged on each of the sections 16 of the first elongated carrier 2, and on the second side 7 of the first elongated carrier 2, a light-emitting element 8 (or possibly several light-emitting elements 8) is arranged on each of the sections 16 of the first elongated carrier 2. No light-emitting element is arranged on the second elongated carrier 3. By stretching out the first elongated carrier 2 and the second elongated carrier 3, having been folded over each other such as illustrated in FIG. 1, such that a plurality of cavities 9 (cf. FIG. 2) in the interleaved structure are formed, the light-emitting elements 8 may be directed in different directions from the lighting device with respect to each other, and in even more directions as compared to, for example, the embodiment of the present invention illustrated in FIG. 7.

Figure 9:
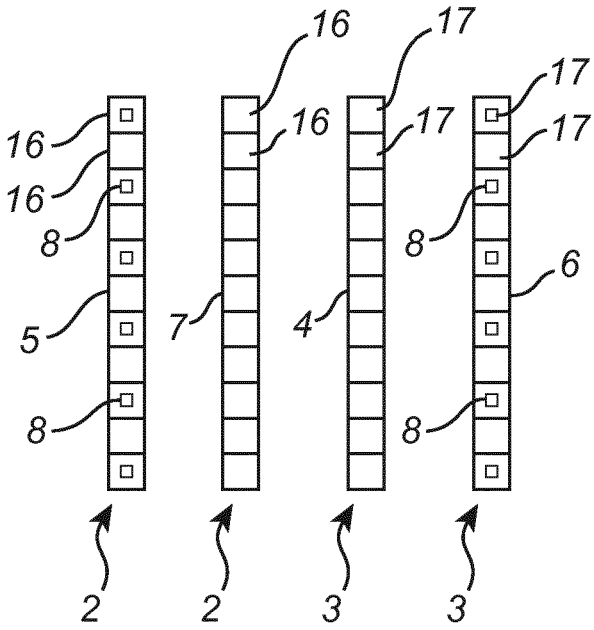

According to the embodiment of the present invention illustrated in FIG. 9, on the first side 5 of the first elongated carrier 2, alternatingly one section 16 in the succession of contiguous sections 16 of the first elongated carrier 2 has a light-emitting element 8 arranged thereon (or possibly several light-emitting elements 8 arranged thereon) and one section 16 in the succession of contiguous sections 16 of the first elongated carrier 2 has no light-emitting element arranged thereon. No light-emitting element is arranged on the second side 7 of the first elongated carrier 2. Furthermore, on the second side 6 of the second elongated carrier 3, alternatingly one section 17 in the succession of contiguous sections 17 of the second elongated carrier 3 has a light-emitting element 8 arranged thereon (or possibly several light-emitting elements 8 arranged thereon) and one section 17 in the succession of contiguous sections 17 of the second elongated carrier 3 has no light-emitting element arranged thereon. Further, no light-emitting element is arranged on the first side 4 of the second elongated carrier 3. A configuration of light-emitting elements 8 in the lighting device such as illustrated in FIG. 9 may be relatively easy to produce—and hence be relatively inexpensive—and may facilitate thermal management in the lighting device. Also, by stretching out the first elongated carrier 2 and the second elongated carrier 3, having been folded over each other such as illustrated in FIG. 1, such that a plurality of cavities 9 (cf. FIG. 2) in the interleaved structure are formed, the light-emitting elements 8 may be directed in different directions from the lighting device with respect to each other. Other ways of positioning the light-emitting elements 8 are however possible. According to another example, the light-emitting elements 8 arranged on the first side 5 of the first elongated carrier 2 may instead be arranged on the second side 7 of the first elongated carrier 2, and the light-emitting elements 8 arranged on the second side 6 of the second elongated carrier 3 may instead be arranged on the first side 4 of the second elongated carrier 3.

Figure 10:
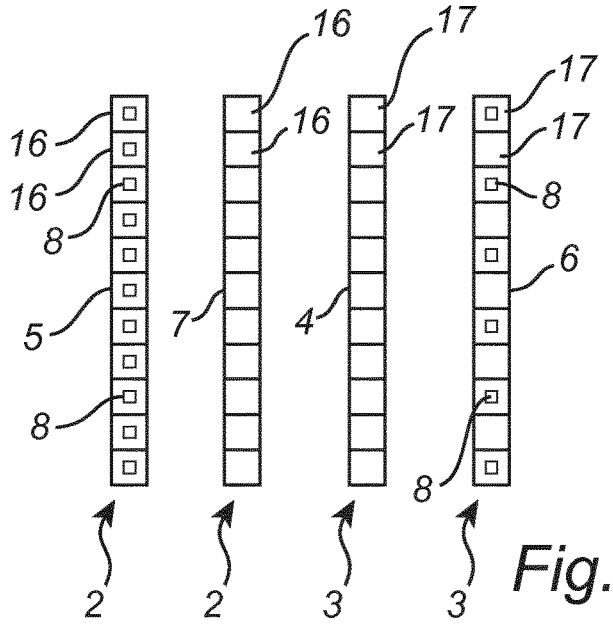

The embodiment of the present invention illustrated in FIG. 10 is similar to the embodiment of the present invention illustrated in FIG. 9. According to the embodiment of the present invention illustrated in FIG. 10, on the first side 5 of the first elongated carrier 2, a light-emitting element 8 (or possibly several light-emitting elements 8) is arranged on each of the sections 16 of the first elongated carrier 2. No light-emitting element is arranged on the second side 7 of the first elongated carrier 2. Furthermore, on the second side 6 of the second elongated carrier 3, alternatingly one section 17 in the succession of contiguous sections 17 of the second elongated carrier 3 has a light-emitting element 8 arranged thereon (or possibly several light-emitting elements 8 arranged thereon) and one section 17 in the succession of contiguous sections 17 of the second elongated carrier 3 has no light-emitting element arranged thereon. Further, no light-emitting element is arranged on the first side 5 of the second elongated carrier 3. Other ways of positioning the light-emitting elements 8 are however possible. According to another example, the light-emitting elements 8 arranged on the first side 5 of the first elongated carrier 2 may instead be arranged on the second side 7 of the first elongated carrier 2, and the light-emitting elements 8 arranged on the second side 6 of the second elongated carrier 3 may instead be arranged on the first side 4 of the second elongated carrier 3.

As described in the foregoing with reference to FIG. 2, for example by stretching out the first elongated carrier 2 and the second elongated carrier 3, having been folded over each other such as illustrated in FIG. 1, a plurality of cavities 9 in the interleaved structure may be formed. With further reference to FIG. 2, each cavity 9 may be at least constituted by a surface 12 of one of the sections 16 of the first elongated carrier 2 and a surface 13 of one of the sections 17 of the second elongated carrier 3, wherein the surfaces 12 and 13 of the sections 16 and 17 of the first elongated carrier 2 and the second elongated carrier 3, respectively, at least in part face each other. As described in the foregoing for example with reference to FIGS. 3-10, one or more light-emitting elements 8 may be arranged on one or more of the sections 16 of the first elongated carrier 2 and/or on one or more of the sections 17 of the second elongated carrier 3. Thereby, one or more light-emitting elements 8 may be arranged inside a cavity.

FIGS. 11-16 are schematic side views of a cavity 9 in an interleaved structure in accordance with embodiments of the present invention. The cavity 9 is (at least) constituted by a surface 12 of a section 16 of the first elongated carrier 2 and a surface 13 of a section 17 of the second elongated carrier 3, wherein one or more light-emitting elements 8 are arranged inside the cavity 9. The examples of the cavity 9 illustrated in FIGS. 11-16 may be implemented in any one of the embodiments of the present invention described herein, such as, for example, in any one of the embodiments of the present invention illustrated in FIGS. 1-10. Also, the different examples of the cavity 9 illustrated in FIGS. 11-16 may be combined in any combination.

Figure 11:
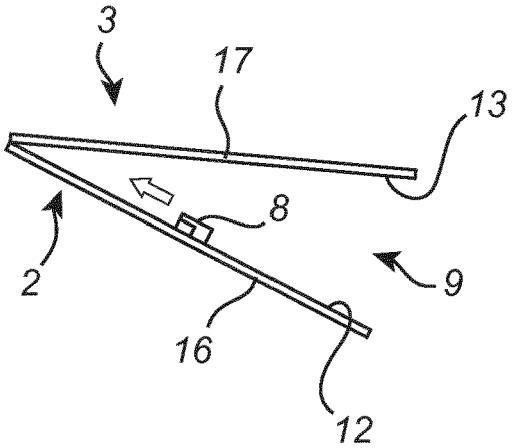
FIGS. 11-16 are schematic side views of a cavity in an interleaved structure in accordance with different embodiments of the present invention.

According to the embodiment of the present invention illustrated in FIG. 11, a light-emitting element 8 is arranged on the surface 12 of the section 16 of the first elongated carrier 2 and so as to emit light in a direction into the cavity 9, as indicated by the arrow in FIG. 11. In addition, or in alternative, a light-emitting element 8 could be arranged on the surface 13 of the section 17 of the second elongated carrier 3 and so as to emit light in a direction into the cavity 9. The light-emitting element 8 could for example comprise a side-emitting LED. There may possibly be several light-emitting elements 8 inside the cavity 9, wherein at least some of the light-emitting elements 8 may be arranged so as to emit light in a direction into the cavity 9. By arranging light-emitting element(s) 8 to emit light in a direction into the cavity 9, an even better light mixing functionality with respect to the light emitted from the lighting device may be achieved.

Figure 12:
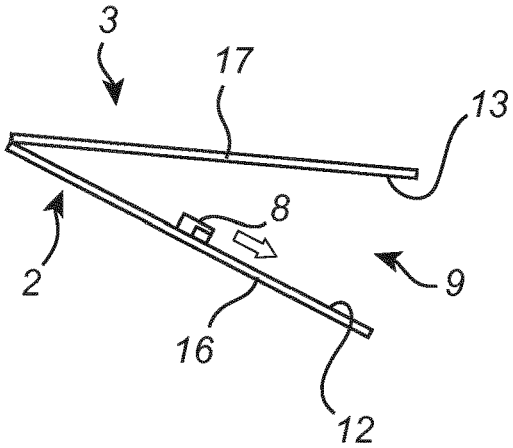

According to the embodiment of the present invention illustrated in FIG. 12, a light-emitting element 8 is arranged on the surface 12 of the section 16 of the first elongated carrier 2 and so as to emit light in a direction out of the cavity 9, as indicated by the arrow in FIG. 12. In addition, or in alternative, a light-emitting element 8 could be arranged on the surface 13 of the section 17 of the second elongated carrier 3 and so as to emit light in a direction out of the cavity 9. The light-emitting element 8 could for example comprise a side-emitting LED. There may possibly be several light-emitting elements 8 inside the cavity 9, wherein at least some of the light-emitting elements 8 may be arranged so as to emit light in a direction out of the cavity 9. By arranging light-emitting element(s) 8 to emit light in a direction out of the cavity 9, an even better light collimation functionality with respect to the light emitted from the lighting device may be achieved.

Figure 13:
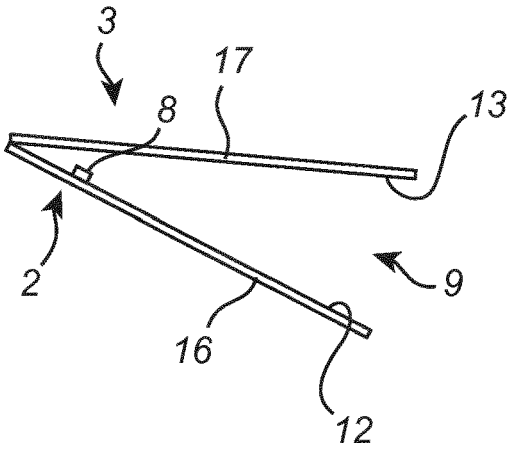

According to the embodiment of the present invention illustrated in FIG. 13, a light-emitting element 8 is arranged on the surface 12 of the section 16 of the first elongated carrier 2 so as to be located relatively far into the cavity 9 (or even as far into the cavity 9 as possible).

As indicated in the foregoing, there may be more than one light-emitting element inside the cavity. The light-emitting elements may be arranged in different ways inside the cavity. Examples of how light-emitting elements may be arranged inside the cavity are illustrated in FIGS. 14-16.

Figure 14:
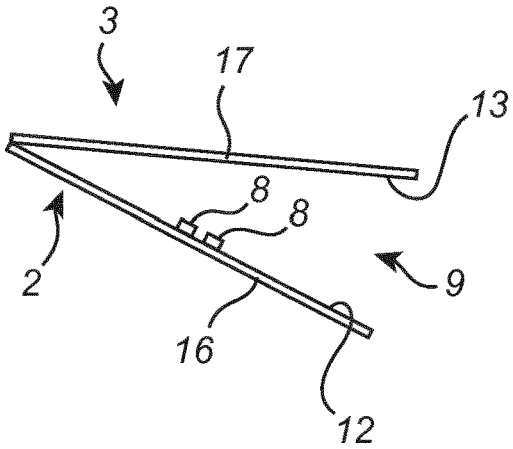

According to the embodiment of the present invention illustrated in FIG. 14, light-emitting elements 8 are arranged on one of the sections 16 and 17 of the first and second elongated carriers 2 and 3, respectively, but not on the other one of the sections 16 and 17. According to the embodiment of the present invention illustrated in FIG. 14, light-emitting elements 8 are arranged on the surface 12 of the section 16 of the first elongated carrier 2, but the light-emitting elements 8 could instead be arranged on the surface 13 of the section 17 of the second elongated carrier 3. Although FIG. 14 depicts two light-emitting elements 8, it is to be understood that there could be provided more than two light-emitting elements 8.

Figure 15:
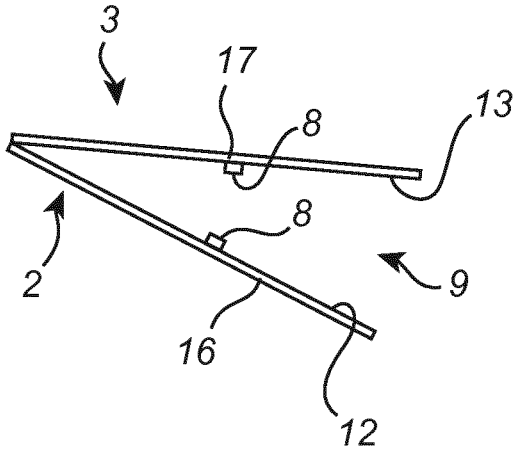
Figure 16:
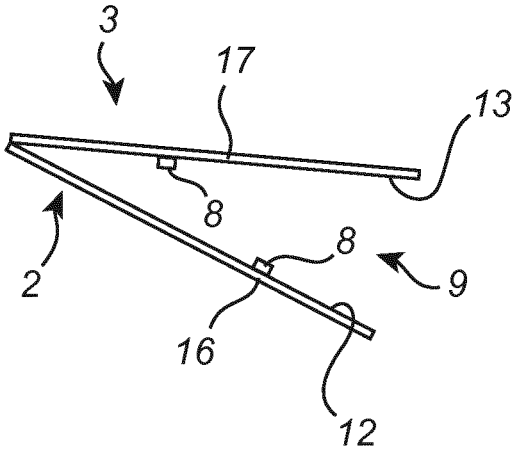

According to the embodiments of the present invention illustrated in FIGS. 15 and 16, light-emitting elements 8 are arranged on both the section 16 of the first elongated carrier 2 and the section 17 of the second elongated carrier 3. Although each of FIGS. 15 and 16 depicts two light-emitting elements 8, it is to be understood that there could be provided more than two light-emitting elements 8.

Figure 17:
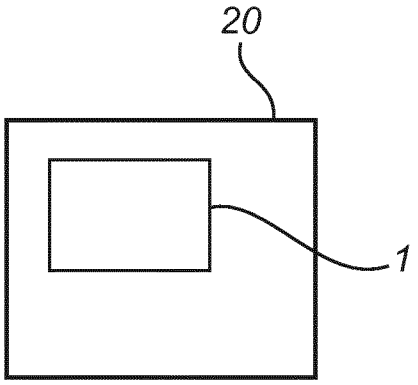
FIG. 17 is a schematic block diagram of an entity comprising a lighting device according to an embodiment of the present invention.

A lighting device according to one or more embodiments of the present invention such as described in the foregoing, for example such as described in the foregoing with reference to any one of FIGS. 1-16, may be used or implemented in different entities. FIG. 17 is a schematic block diagram of an entity 20 comprising a lighting device 1 according to one or more embodiments of the present invention. The entity 20 may for example comprise or be constituted by a lamp, a light engine, or a luminaire. The lamp could for example comprise or be constituted by a LED lamp, such as, for example, a tubular LED lamp, a so called LED bulb, or as a replacement for a coil in a LED retrofit lamp having an appearance similar to a 'traditional' incandescent light bulb.

Figure 18:
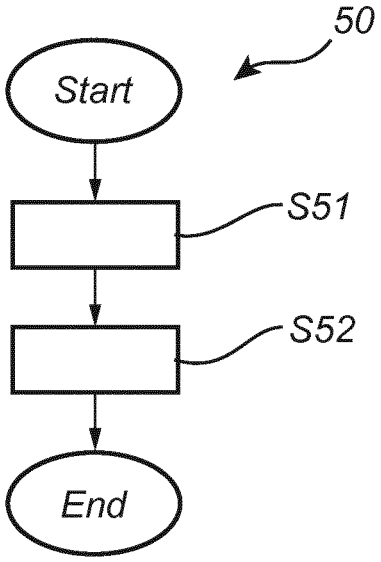
FIG. 18 is a schematic flowchart of a method of manufacturing a lighting device according to an embodiment of the present invention.

FIG. 18 is a schematic flowchart of a method 50 of manufacturing a lighting device comprising at least a first elongated carrier and a second elongated carrier. At least one of the first elongated carrier and the second elongated carrier is configured to support at least one light-emitting element. Each of the first elongated carrier and the second elongated carrier is foldable. The method 50 comprises, S52, folding at least the first elongated carrier and the second elongated carrier (possibly repeatedly) over each other such that a plurality of sections (or portions) of the first elongated carrier are interleaved with respect to a plurality of sections (or portions) of the second elongated carrier so as to form an interleaved structure. The method 50 may comprise, prior to step S52, providing the at least a first elongated carrier and the second elongated carrier, S51.

In conclusion, a lighting device is disclosed, comprising at least a first elongated carrier and a second elongated carrier, each of the first elongated carrier and the second elongated carrier being foldable. At least the first elongated carrier and the second elongated carrier have been folded over each other such that a plurality of sections of the first elongated carrier are interleaved with respect to a plurality of sections of the second elongated carrier so as to form an interleaved structure. The interleaved structure may have been arranged such that a plurality of cavities in the interleaved structure are formed, each cavity at least being constituted by a surface of one of the sections of the first elongated carrier and a surface of one of the sections of the second elongated carrier, wherein the surfaces of the sections of the first elongated carrier and the second elongated carrier, respectively, at least in part face each other.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device comprising:

at least a first elongated carrier and a second elongated carrier, at least one of the first elongated carrier and the second elongated carrier being configured to support at least one light-emitting element, each of the first elongated carrier and the second elongated carrier being foldable;

wherein at least the first elongated carrier and the second elongated carrier have been repeated folded over each other, thereby forming a plurality of folds in each of the first elongated carrier and the second elongated carrier, such that a plurality of sections of the first elongated carrier are interleaved with respect to a plurality of sections of the second elongated carrier so as to form an interleaved structure.

2. A lighting device according to claim 1, wherein each of the first elongated carrier and the second elongated carrier is flexible, and wherein the interleaved structure has been arranged such that a plurality of cavities in the interleaved structure are formed, each cavity at least being constituted by a surface of one of the sections of the first elongated carrier and a surface of one of the sections of the second elongated carrier, wherein the surfaces of the sections of the first elongated carrier and the second elongated carrier, respectively, at least in part face each other.

3. A lighting device according to claim 2, wherein at least the first elongated carrier comprises a plurality of light-emitting elements supported thereby, and wherein at least one of the light-emitting elements is arranged on each of at least some of the sections of the first elongated carrier, wherein each of at least some of the cavities has at least one light-emitting element arranged on the section of the first elongated carrier of the cavity.

4. A lighting device according to claim 2, wherein the second elongated carrier comprises a plurality of light-emitting elements supported by the second elongated carrier, wherein at least one of the light-emitting elements is arranged on each of at least some of the sections of the second elongated carrier, and wherein each of at least some of the cavities has at least one light-emitting element arranged on the section of the second elongated carrier of the cavity.

5. A lighting device according to claim 1, wherein at least the first elongated carrier comprises a plurality of light-emitting elements supported by the first elongated carrier, wherein at least one of the light-emitting elements is arranged on each of at least some of the sections of the first elongated carrier.

6. A lighting device according to claim 5, wherein the first elongated carrier comprises at least a first side and a second side, each of the first side and the second side extending along the length of the first elongated carrier, and wherein the plurality of light-emitting elements are arranged on the first side of the first elongated carrier but not on the second side of the first elongated carrier.

7. A lighting device according to claim 5, wherein each of the plurality of sections of the first elongated carrier is adjoining at least one other section of the plurality of sections of the first elongated carrier so as to form a succession of contiguous sections, wherein alternatingly at least one section in the succession of contiguous sections has at least on light-emitting element arranged thereon and at least one section in the succession of contiguous sections has no light-emitting element arranged thereon.

8. A lighting device according to claim 5, wherein each of the plurality of sections of the first elongated carrier is adjoining at least one other section of the plurality of sections of the first elongated carrier so as to form a succession of contiguous sections, wherein each section in the succession of contiguous sections has at least on light-emitting element arranged thereon, wherein alternatingly at least one section in the succession of contiguous sections has at least one light-emitting element arranged thereon on the first side and at least one section in the succession of contiguous sections has at least one light-emitting element arranged thereon on the second side.

9. A lighting device according to claim 5, wherein the second elongated carrier comprises a plurality of light-emitting elements supported by the second elongated carrier, wherein at least one of the light-emitting elements is arranged on each of at least some of the sections of the second elongated carrier.

10. A lighting device according to claim 9, wherein the second elongated carrier comprises at least a first side and a second side, each of the first side and the second side extending along the length of the second elongated carrier, and wherein the plurality of light-emitting elements are arranged on the first side of the second elongated carrier but not on the second side of the second elongated carrier.

11. A lighting device according to claim 9, wherein each of the plurality of sections of the second elongated carrier is adjoining at least one other section of the plurality of sections of the second elongated carrier so as to form a succession of contiguous sections, wherein alternatingly at least one section in the succession of contiguous sections has at least on light-emitting element arranged thereon and at least one section in the succession of contiguous sections has no light-emitting element arranged thereon.

12. A lighting device according to claim 1, wherein the first elongated carrier has a width different from a width of the second elongated carrier, wherein a ratio between a width of the first elongated carrier and a width of the second elongated carrier is in a range between 0.2 and 5.

13. A lighting device according to claim 1, wherein the lighting device is arranged such that the at least the first elongated carrier and the second elongated carrier in the interleaved structure are fixedly arranged with respect to each other.

14. A lamp, a light engine or a luminaire comprising a lighting device according to claim 1.

15. A method of manufacturing a lighting device comprising at least a first elongated carrier and a second elongated carrier, at least one of the first elongated carrier and the second elongated carrier being configured to support at least one light-emitting element, and each of the first elongated carrier and the second elongated carrier being foldable, the method comprising:

repeated folding at least the first elongated carrier and the second elongated carrier over each other thereby forming a plurality of folds in each of the first elongated carrier and the second elongated carrier, such that a plurality of sections of the first elongated carrier are interleaved with respect to a plurality of sections of the second elongated carrier so as to form an interleaved structure.

* * * * *